United States Patent [19]

Bielefeldt

[11] Patent Number: 5,063,869

[45] Date of Patent: Nov. 12, 1991

[54] WING TYPE SAILING YACHT

[75] Inventor: Ernst-August Bielefeldt, Hollenstedt, Fed. Rep. of Germany

[73] Assignee: Deutsche Airbus GmbH, Hamburg, Fed. Rep. of Germany

[21] Appl. No.: 407,550

[22] Filed: Sep. 15, 1989

[30] Foreign Application Priority Data

Sep. 16, 1988 [DE] Fed. Rep. of Germany ..... 3831468

[51] Int. Cl.[5] ..... B63B 1/22

[52] U.S. Cl. ..... 114/61; 114/283

[58] Field of Search ..... 114/56, 61, 274, 280, 114/281, 271, 283, 288, 292, 39.1; 244/106; D12/303, 304, 309

[56] References Cited

U.S. PATENT DOCUMENTS

| | | | |
|---|---|---|---|
| 2,646,235 | 7/1953 | Dawson | 114/283 |
| 3,862,366 | 4/1974 | Mankawich | 114/61 |
| 3,922,994 | 12/1975 | De Long | 114/39.1 |
| 3,949,695 | 4/1976 | Pless | 114/283 |
| 3,964,417 | 6/1976 | Williams | 114/283 |
| 3,996,872 | 12/1976 | Pinchot | 114/283 |
| 4,080,922 | 3/1978 | Brubaker | 114/282 |
| 4,164,909 | 8/1979 | Ballard | 114/282 |
| 4,561,371 | 12/1985 | Kelley | 114/61 |
| 4,685,641 | 8/1987 | Kirsch | 114/283 |
| 4,926,733 | 5/1990 | Manor | 114/61 |

*Primary Examiner*—Joseph F. Peters, Jr.
*Assistant Examiner*—Clifford T. Bartz
*Attorney, Agent, or Firm*—W. G. Fasse; D. H. Kane, Jr.

[57] ABSTRACT

A wing type sailing yacht is constructed to incorporate the airfoil principle. Such a yacht has a boat hull, a mast, and a sail, including a bow with a bow keel and a stern with a stern keel. Each keel has a buoyancy control fin (9, 10) at its lower end. An outrigger arm (6, 6') is attached laterally to each side of the hull. The end of each outrigger arm carries a downwardly projecting fin strut which in turn carries a further buoyancy control fin (8, 8'). The buoyancy control fins (9, 10, 8, 8') form a four-point wing or airfoil type system for producing lift or buoyancy and for maneuverability and stability. The outrigger arms (6, 6') are built as narrow surface wing type carriers having a negative sweepback. The arms have a predetermined elasticity. A pontoon (12, 12') is attached to the end of each outrigger arm. The fin struts act as lateral control fins or steering wings (11, 11').

16 Claims, 6 Drawing Sheets

WING TYPE SAILING YACHT

FIELD OF THE INVENTION

The invention relates to a wing type sailing yacht, wherein wing surfaces provide lift or rather buoyancy and steering surfaces.

BACKGROUND INFORMATION

Sailing yachts, especially high performance sailing yachts, are constructed for efficiency regarding the utilization of wind power, minimizing of water resistance or drag, and regarding their maneuverability and stability. There is room for improvement, however, of the respective characteristics of known sailing yachts.

A yacht is known from the cover page of the Thursday, July 7, 1988 issue of the British newspaper, *The Times*, showing a yacht essentially having a hull and a sail, with bow and stern keels. The bottom ends of the keels are provided with a buoyancy control fin. An outrigger is attached laterally to each side of the hull. The end of each outrigger carries a fin strut or wing strut projecting downwardly and carrying several buoyancy control fins. Said buoyancy control fins form a four-point wing or airfoil surface system for producing lift or rather buoyancy and for steering and stabilizing. The yacht is depicted in a high speed condition, whereby the hull and the outriggers are located above the surface of the water. The known yacht does not show any means for accelerating the transitional phase from the submerged state to the high speed state. As a result, at the start, when an adequate carrying or lifting capacity of the wing system has not yet been achieved, movement can be highly unstable. Furthermore, it is to be expected, from the depicted fin or wing configurations, that there are relatively high induced drag values. The wetted hull surface or underwater configuration of the hull does not appear to be minimized at all.

OBJECTS OF THE INVENTION

In view of the foregoing it is the aim of the invention to achieve the following objects singly or in combination:

to construct a sailing yacht of this type so as to improve the efficiency of using the wind power, minimizing the induced drag, reducing the wetted surface area, and providing an improved overall stabilization;

to use a combined tandem keel and rudder system with high speed steering surfaces having minimal surface areas;

to develop a sailing yacht for construction of modern fiber composite materials; and to assure an improved hydro-dynamic lift or buoyancy generation.

SUMMARY OF THE INVENTION

A sailing yacht according to the invention is characterized by the combination of the following features. The outriggers or outrigger arms are constructed as narrow surface wing type carriers having a negative sweepback and a predetermined elasticity. A float or pontoon is attached to the outer end of each outrigger arm of said wing type carriers. Each outrigger arm further has at its outer end a downwardly projecting fin strut which acts as a lateral steering wing. These features minimize the surface area of the high speed control surfaces needed for the steering and overall control of the yacht. Additionally these features improve the overall stability of the yacht with its combined tandem-keel and rudder system.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
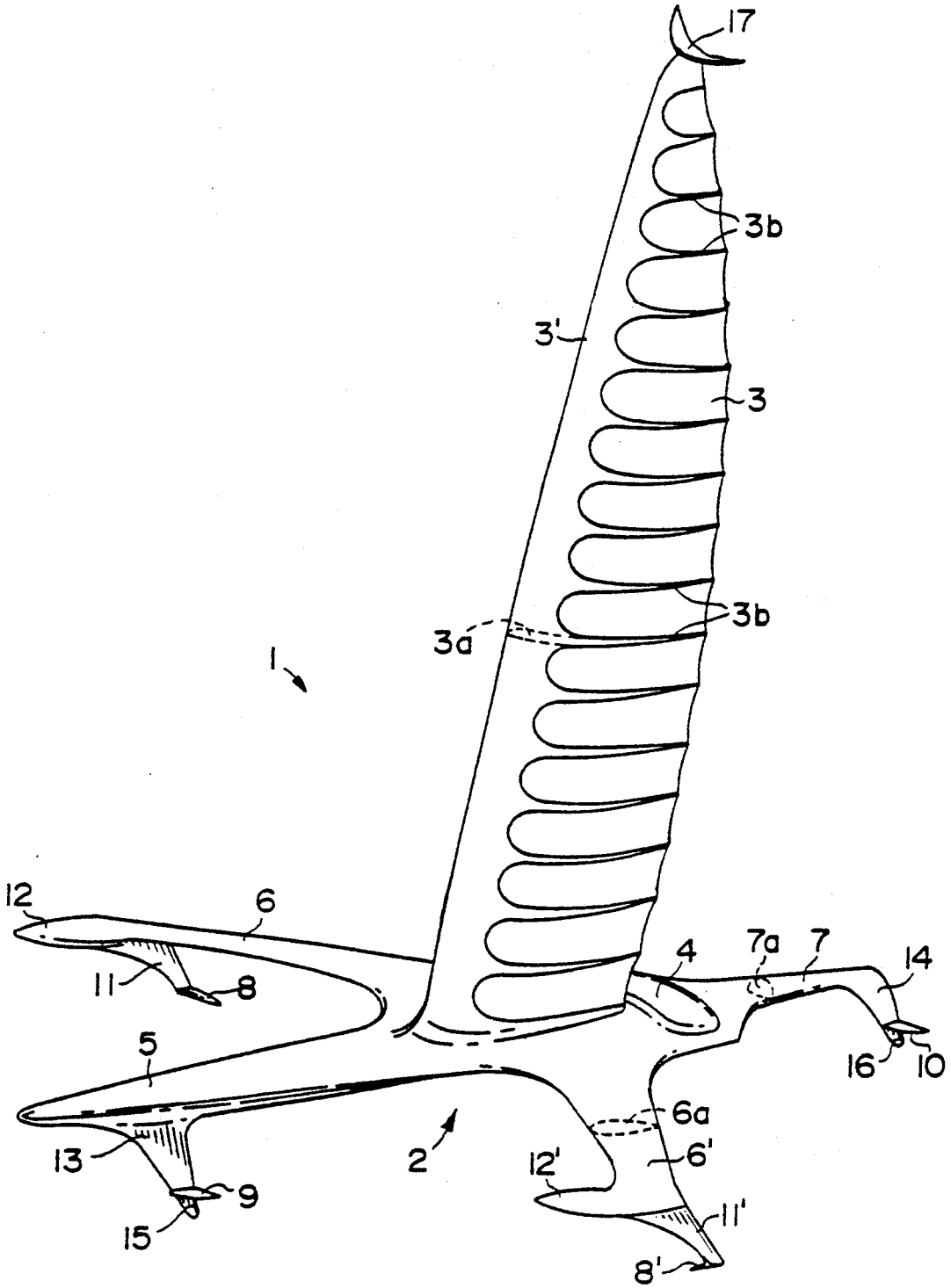
FIG. 1 is an elevational perspective view of a sailing yacht according to the invention.

FIG. 1 shows a sailing yacht 1 in a close-to-the-wind sailing configuration. The yacht essentially comprises a hull 2 and a sail 3 integral with a mast 3'. The sail 3 is shown as a solid profiled sail, the cross-sectional curved profile of which is shown by dashed lines at **3*a*. The sail 3 has ribs 3*b*. The yacht further comprises a tandem keel system including a bow keel 13 and a stern keel 14. A four-point support or lift fin system is formed by two first bow buoyancy control surfaces 9 secured to a bow keel 13, by second stern buoyancy control surfaces 10 secured to a bow keel 14 and by two third and fourth lateral buoyancy control fins or surfaces 8 and 8'. While the first and second buoyancy control surfaces 9, 10 are arranged on the respective keels 13 and 14, the third and fourth fins 8, 8' are secured to fin struts 11, 11' projecting downwardly from respective outrigger arms 6, 6'**. The customary spinnaker and additional specialized sails for full or space wind and for half wind courses are not shown.

Figure 3:
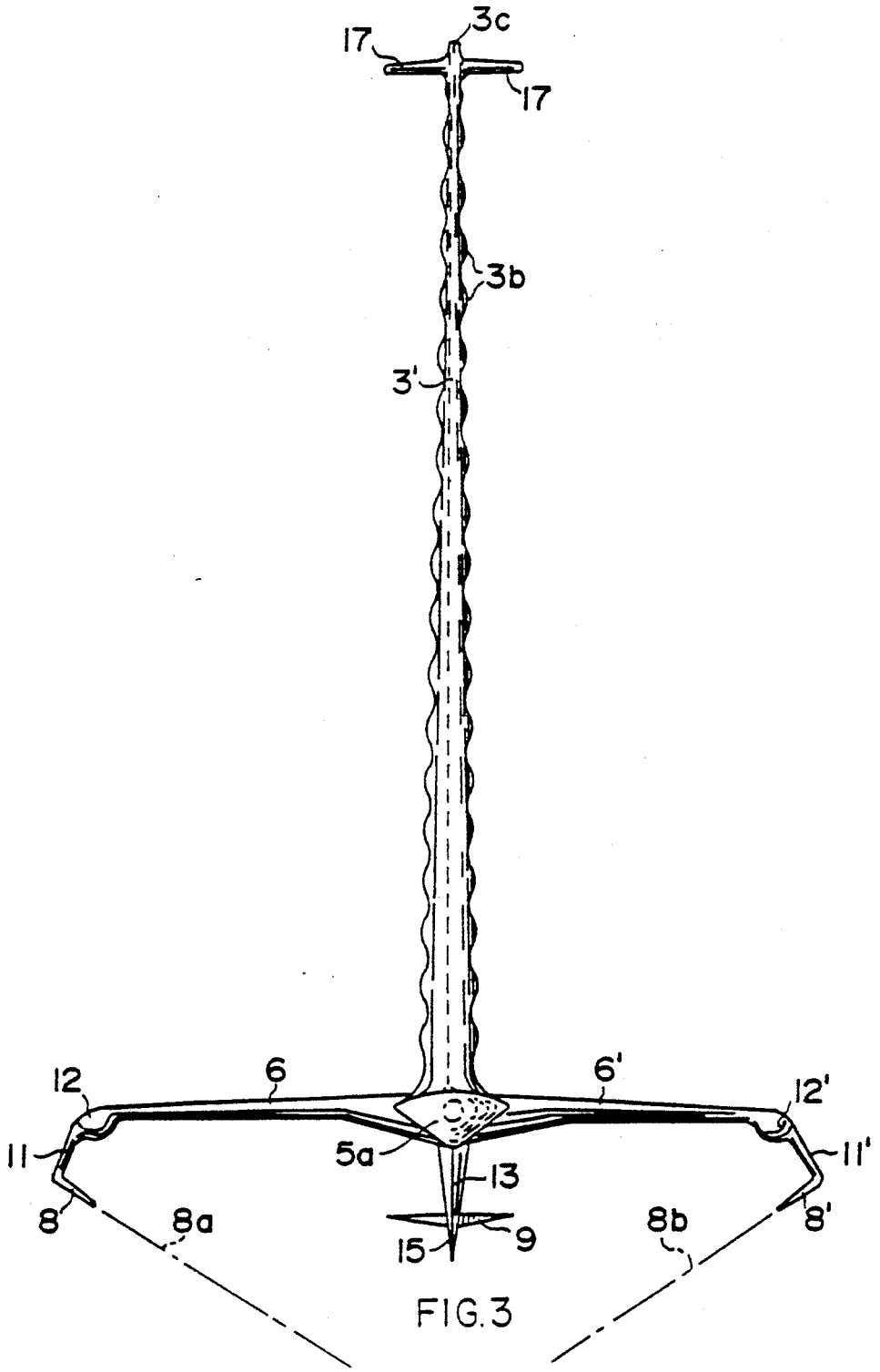
FIG. 3 is an elevational front view of the wing type sailing yacht of FIG. 1, with the viewing direction extending from bow to stern and the sail being aligned with the viewing direction, however showing a somewhat modified position of an end disk just below the mast tip.
Figure 4:
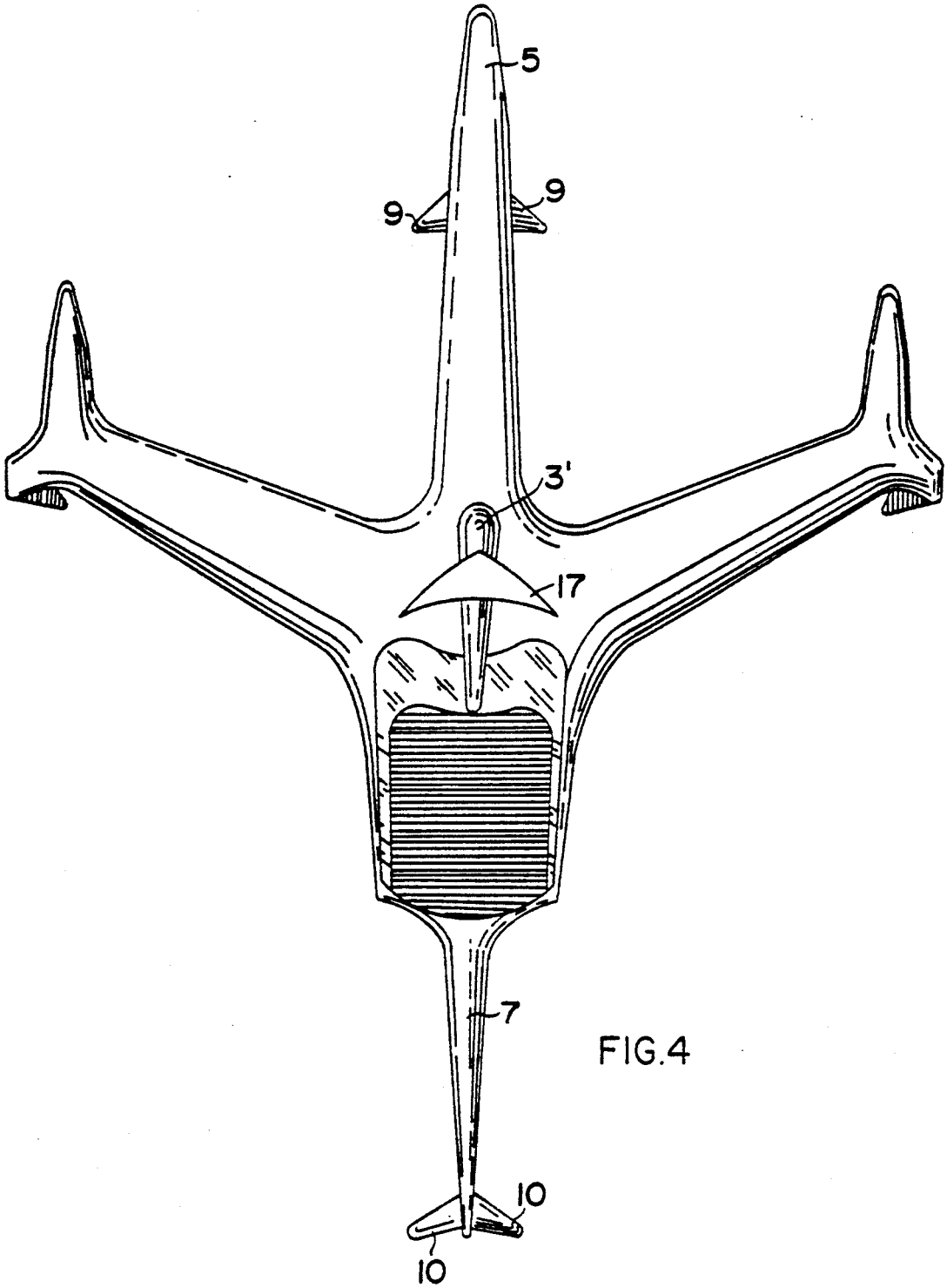
FIG. 4 is a top plan view of the wing type sailing yacht of FIG. 1.
Figure 5:
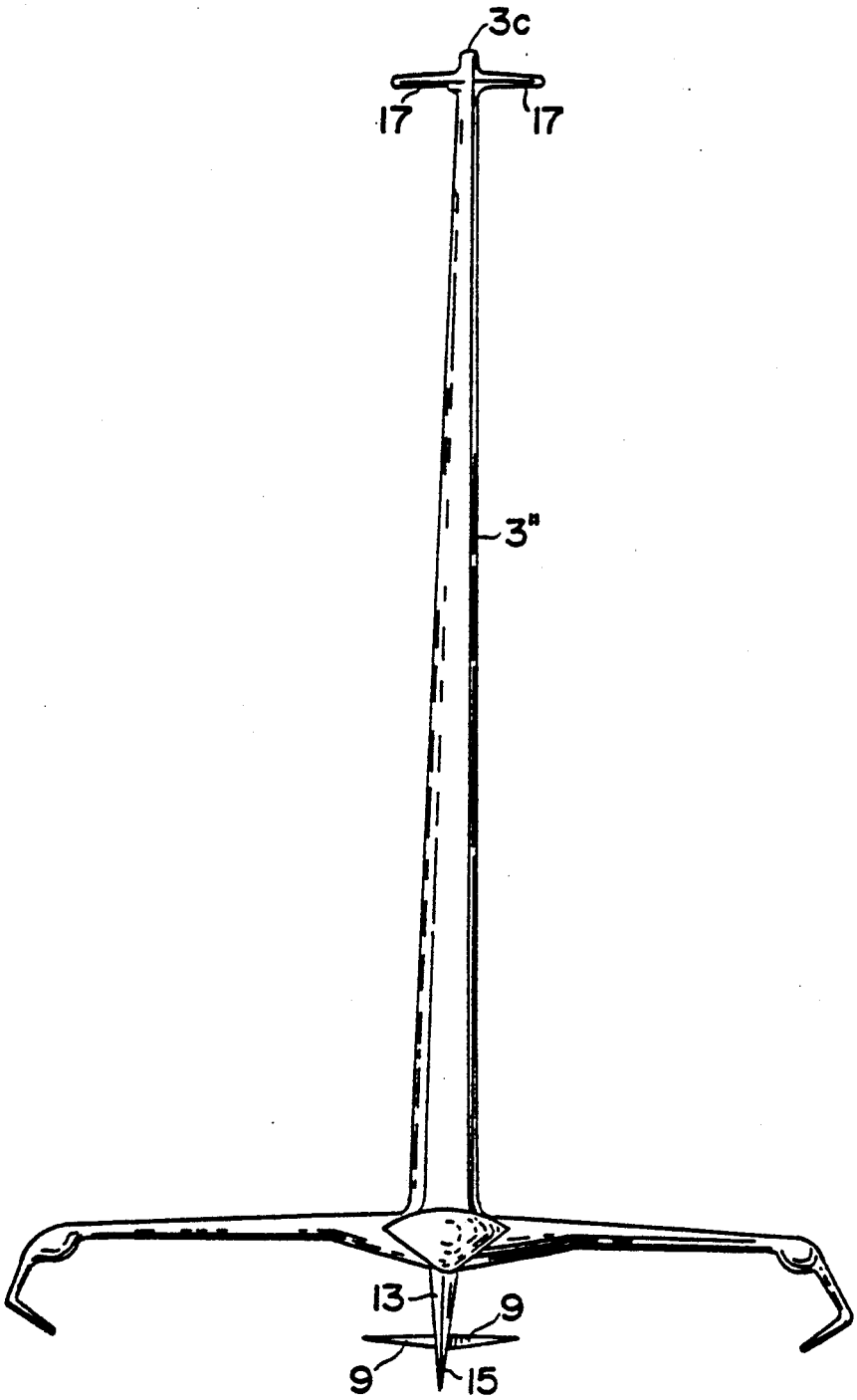
FIG. 5 is a view similar to that of FIG. 3, but showing a modified mast.

The outrigger arms 6, 6' are laterally secured to or integrally formed with the hull 2. These outrigger arms 6, 6' have a cross-section as shown at **6*a*. The downwardly projecting fin struts 11, 11' are located at the ends of the outrigger arms 6, 6', for the mounting of the third and fourth lateral buoyancy control fins 8, 8'. Hydro-dynamically molded or shaped pontoons 12, 12' are attached to the ends of the outrigger arms 6, 6'. High speed bow and stern rudders 15, 16 are located below the first and second buoyancy control surfaces or fins 9, 10. The rudders 15, 16, together with the respective keels 13, 14 and buoyancy control surfaces 9, 10, form a first cross-configuration 13, 9, 15 at the bow and a second cross-configuration 14, 10, 16 at the stern. The outrigger arms 6, 6' have narrow surfaces and are swept forward with a negative sweepback similar to aircraft wings. The first cross-configuration 13, 9, 15 below the bow 5 is also seen in FIGS. 3 and 5**.

The bow portion 5 of the hull 2 has a slender form. In cross-section, the respective underwater portion of the bow has a concave curved V-shape 5*a* shown in FIG. 3 facing downwardly, thereby forming a water repellent shape. Thus, spray water is deflected to the sides by this water repelling V-shape 5*a*.

The sail 3 is arranged at about midship, approximately where the outrigger arms 6, 6' are connected to the hull 2. The cockpit 4 is located aft of the sail 3 and has a wide form, so that one has a good visibility toward the bow. In other words, the length of the cockpit 4 extends across the width of the hull 2. A stern or tail boom 7 is connected to the cockpit 4. The stern keel 14 is attached to the end of the tail boom 7. For reasons of weight and aerodynamics, the tail boom 7 has a minimal cross-section 7*a* shown in FIG. 1. The sail 3 is constructed as a solid profiled sail as shown at 3*a*. Further, the sail 3 is equipped at its top with an end disk 17 for the reduction of induced drag. The end disk 17 is clearly shown in all FIGS. 1 to 6.

Figure 2:
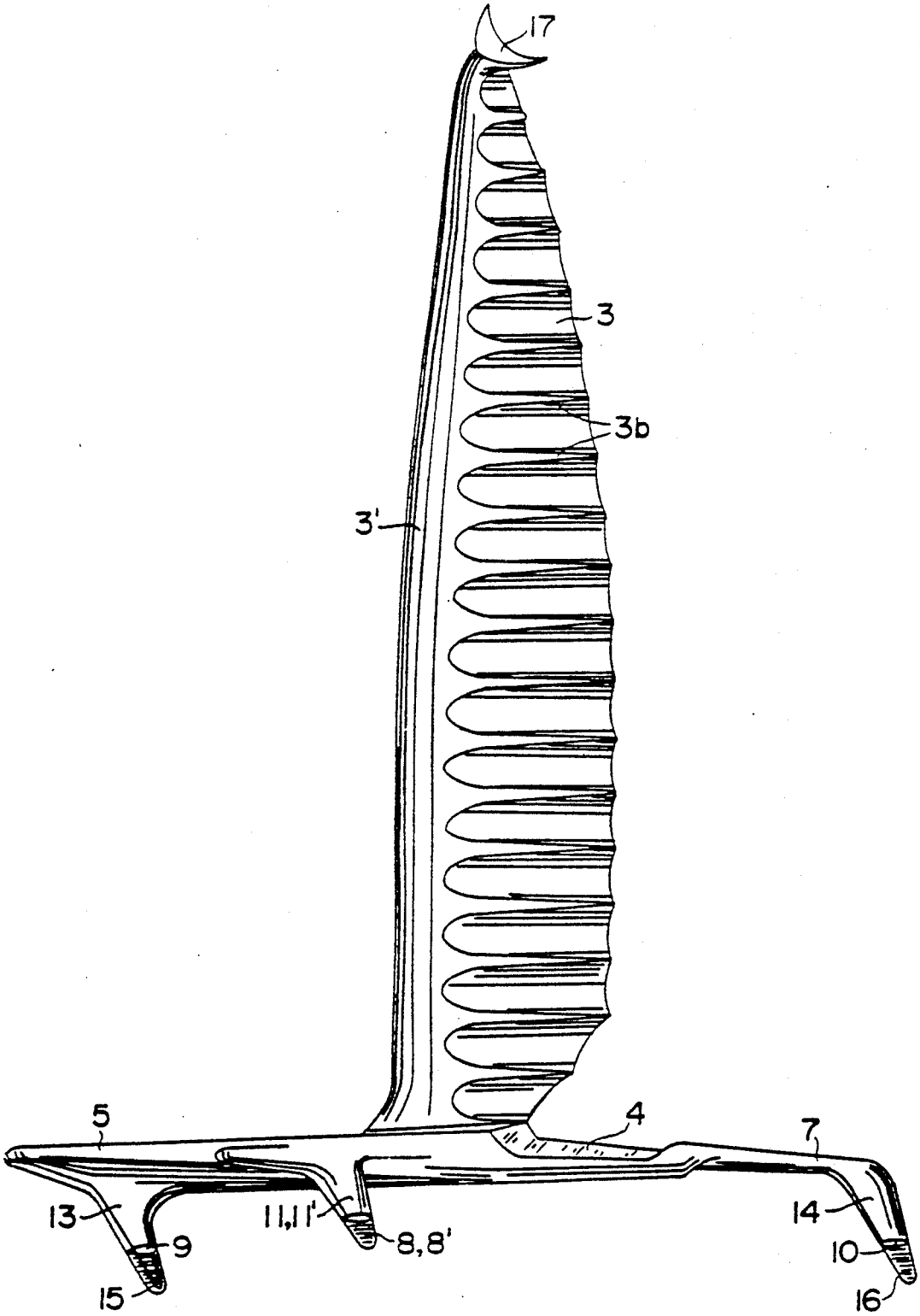
FIG. 2 is an elevational side view of the wing type sailing yacht of FIG. 1 illustrating lateral steering wings or fin struts with a positive sweepback.
Figure 6:
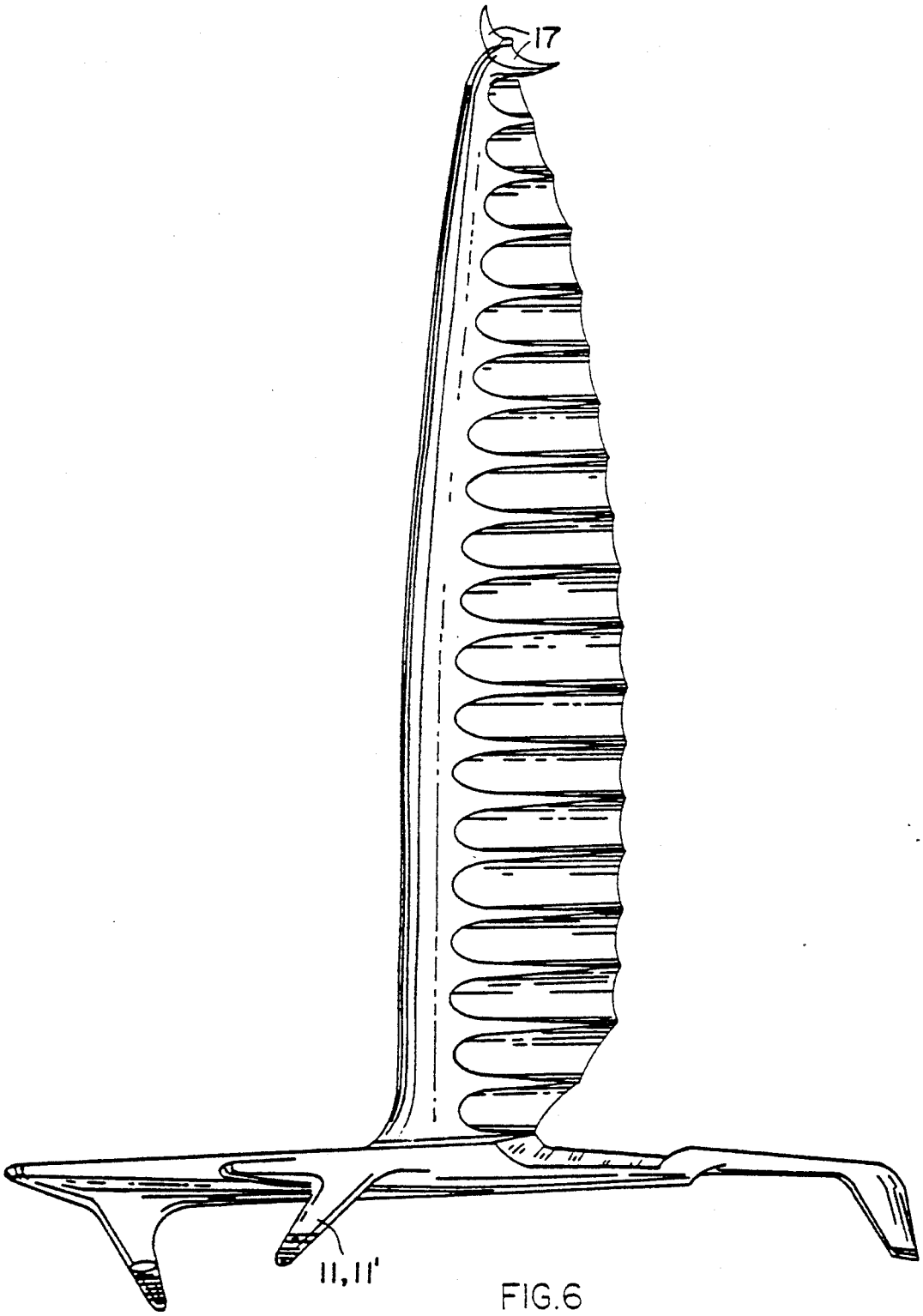
FIG. 6 is a view similar to that of FIG. 2, but showing lateral steering wings or fin struts with a negative sweepback.

The lateral downwardly projecting fin struts 11, 11' are swept back toward the stern, thereby having a positive sweepback as shown in FIGS. 1 and 2. However, these struts 11, 11' may instead have a forward negative sweepback as shown in FIG. 6. Such a negative sweepback in combination with a predetermined elasticity of the outrigger arms 6, 6' and in cooperation with the lateral buoyancy control fins 8, 8' results in an increased stability, which is due to an enlargement of the angle of attack of the fins 8, 8' resulting from an increased load on said outrigger arms 6, 6' and due to the elasticity of the outrigger arms 6, 6'. Thereby, the fins 8, 8' exhibit an increased carrying capacity or buoyancy.

The lateral buoyancy control fins 8, 8', together with the lower ends of the downwardly projecting fin struts 11, 11' form an L-shaped best seen in FIGS. 3 and 5, so that the ends of the buoyancy control fins 8, 8' point to the median or central plane of the yacht. It is advantageous for the reduction of induced drag to employ such an L-shape rather than a T-shape.

The pontoons 12, 12' of the example embodiment have a hydrodynamic form, so that during sailing, when said pontoons 12, 12' are submerged, only minimal water resistance or drag is produced. Further, the pontoons 12, 12' are employed as ballast tanks. For this purpose an intake system operated by dynamic pressure is provided, so that the tanks can be filled quickly if necessary simply by the pressure generated by the movement of the pontoon through the water. In order to empty the tanks, a quick release valve or flap is located on the underside, namely the side facing the water or on the stern end of the tanks. Intake ports are provided at suitable points in the intake system, preferably at points of intersection of the fore and aft control surfaces or fins. However, extendable intake devices may be arranged at other points of the bodies forming the yacht, for example, directly on the pontoons 12, 12'.

Prior to starting, the pontoons 12, 12' and the keels 13, 14 of the yacht are submerged in the water. With increasing speed, the four fins 9, 10, 8, 8' become operative and the ship's hull is lifted above the surface of the water. This transitional phase during which the hull emerges out of the water is accelerated, or rather its duration shortened, by the hydro-dynamic form of the hull, which is designed for maximum lift. All known means of hydro-dynamics, such as S-shaped underwater contours and the like are useable to facilitate this lifting procedure.

FIG. 1 shows the yacht 1 at high speed travel close to the wind, whereby the entire hull is located above the surface of the water. Only the keels 13, 14 and the lateral control fin 11' on the port side are submerged, whereby the yacht is carried by the bow and stern buoyancy control surfaces or fins 9, 10 and by the buoyancy control surface or fin 8' on the leeward side. The fin 8 is not submerged. In this travel position, only a minimal surface of the yacht is in contact with the water, thereby substantially reducing drag. When the yacht is pitching, a stabilizing damping effect arises, since the bow keel 13 and the stern keel 14, especially in their upper portions, are built so that their cross-section surface diminishes steadily downwardly. This form or shape makes sure that the displacement of the keels increases quickly as the keels are submerged deeper and deeper, so that the keels act as hydrostatic stabilizers.

In the frontal view shown in FIGS. 3 and 5, the axes of the lateral buoyancy control fins 8, 8' form a V-shape as indicated by dashed lines 8*a* and 8*b* in FIGS. 3. Through this V-form, the vertically projected surface of the submerged leeward buoyancy control fin 8' is enlarged when the yacht pitches more under the lateral thrust of the wind. This feature results in a stabilizing effect about the longitudinal axis. FIGS. 3 and 5 further show a slightly modified position of the end disk 17 just a bit below the sail and mast tip 3*c*. FIG. 5 shows a mast 3'' with a smooth surface rather than with ribs as in FIG. 3.

Due to the stable conditions achieved by the aforementioned features of the outrigger arms 6, 6' and of the keels 13, 14, automatic stabilizing means are largely unnecessary. Nevertheless, the present yacht has numerous means for rapid maneuvering. For this purpose, the keels 13, 14 are constructed to swivel or tilt about their respective profile or longitudinal axis, whereby a very effective steering about the vertical axis is achieved. Furthermore, the lateral control fins 11, 11', as well as buoyancy control fins 8, 8' are also constructed to swivel or tilt about their respective profile or longitudinal axis.

Although the invention has been described with reference to specific example embodiments, it will be appreciated, that it is intended to cover all modifications and equivalents within the scope of the appended claims.

What I claim is:

1. A wing type sailing yacht, comprising a hull (2), a mast (3*a*), and a sail (3) carried by said mast, said hull having a bow (5) with a bow keel (13) and a stern (7) with a stern keel (14), said bow keel (13) having first buoyancy control surfaces (9) at its lower end, said stern keel (14) having second buoyancy control surfaces (10) at its lower end, an outrigger arm (6, 6') attached laterally to each side of said hull (2), an approximately downwardly projecting fin strut (11, 11') acting as a lateral steering wing at the end of each of said outrigger arms (6, 6'), a third buoyancy control surface (8) at one of said fin struts (11), and a fourth buoyancy control surface (8') at the other of said fin struts (11'), said first, second, third and fourth buoyancy control surfaces (9, 10, 8, 8') forming a four-point wing system for producing lift, for steering, and for stabilizing, said outrigger arms (6, 6') comprising narrow elastic surface wing type carriers having a negative sweepback, pontoons (12, 12') attached to ends of said wing type carriers (6, 6'), said third and fourth buoyancy control surfaces (8, 8') and said fin struts (11, 11') forming together an L-shape, said bow keel (13) having a high speed bow rudder (15) secured to said bow keel (13) below said first buoyancy control surfaces (9) to form a first cross-configuration (13, 9, 15), said stern keel (14) having a high speed stern rudder (16) secured to said stern keel (14) below said second buoyancy control surfaces (10) to form a second cross-configuration (14, 10, 16).

2. The wing type sailing yacht of claim 1, wherein said pontoons (12, 12') are capable of generating buoyancy.

3. The wing type sailing yacht of claim 2, wherein said pontoons are constructed as ballast tanks.

4. The wing type sailing yacht of claim 1, wherein said bow keel (13) and said stern keel (14) have at least one keel section with cross-sectional areas decreasing steadily in a downward direction away from said hull.

5. The wing type sailing yacht of claim 4, wherein said at least one keel section is an upper keel section near said hull.

6. The wing type sailing yacht of claim 1, wherein said stern of said hull is constructed as a tail boom (7).

7. The wing type sailing yacht of claim 1, wherein said third buoyancy control surface (8) and said fourth buoyancy control surface (8') slant toward each other.

8. The wing type sailing yacht of claim 1, wherein said hull has an underwater portion having a water repelling configuration (5*a*).

9. The wing type sailing yacht of claim 1, wherein said downwardly projecting fin struts (11, 11') have a positive sweepback.

10. The wing type sailing yacht of claim 1, wherein said downwardly projecting fin struts (11, 11') have a negative sweepback.

11. The wing type sailing yacht of claim 1, wherein said hull (2) comprises a cockpit (4) having a substantial length across the width of said hull.

12. The wing type sailing yacht of claim 1, wherein said sail (3) has a solid curved cross-sectional profile (3*a*).

13. The wing type sailing yacht of claim 1, wherein said sail and mast comprise an end disk (17) at the upper end thereof.

14. The wing type sailing yacht of claim 1, wherein said bow keel (13) and said stern keel (14) are constructed for tilting about their respective profile axis.

15. The wing type sailing yacht of claim 1, wherein said downwardly projecting fin struts (11, 11') are constructed for tilting about their respective profile axis.

16. The wing type sailing yacht of claim 1, wherein said third and fourth buoyancy control surfaces (8, 8') are constructed for tilting about their respective profile axis.

* * * * *